US005690275A

United States Patent [19]

Bose et al.

[11] Patent Number: 5,690,275

[45] Date of Patent: Nov. 25, 1997

[54] CONTAINER WITH APERTURES FOR VENTILATION

[75] Inventors: Ajit Kumar Bose, Lawrenceville, N.J.; Fernando Tapia, Bancagua, Chile

[73] Assignee: Union Camp Corporation, Wayne, N.J.

[21] Appl. No.: 644,913

[22] Filed: May 29, 1996

Related U.S. Application Data

[60] Provisional application No. 60/000,536, Oct. 2, 1995.

[51] Int. Cl. [6] ..... B65D 5/20

[52] U.S. Cl. ..... 229/120; 220/676

[58] Field of Search ..... 229/103.2, 120, 229/120.1, 916; 220/676

[56] References Cited

U.S. PATENT DOCUMENTS

| | | | |
|---|---|---|---|
| 2,339,445 | 1/1944 | Wynne et al. . | |
| 2,398,797 | 4/1946 | Meyer et al. | 229/120.1 X |
| 3,114,493 | 12/1963 | Dunkin . | |
| 3,157,346 | 11/1964 | Hamilton . | |
| 3,270,713 | 9/1966 | Rubricius | 229/120.1 X |
| 3,343,744 | 9/1967 | Morell et al. . | |
| 3,520,468 | 7/1970 | Wiemann . | |
| 3,682,351 | 8/1972 | De Putter | 220/676 X |
| 3,817,371 | 6/1974 | Gatter | 220/676 X |
| 3,973,723 | 8/1976 | Owens . | |
| 4,053,098 | 10/1977 | Baptist . | |
| 4,056,223 | 11/1977 | Williams . | |
| 4,129,247 | 12/1978 | McCall . | |
| 4,151,948 | 5/1979 | De La Fuente, Jr. . | |
| 4,175,691 | 11/1979 | Cornell et al. . | |
| 4,537,344 | 8/1985 | Thomas . | |
| 4,770,339 | 9/1988 | Weimer | 229/120 |
| 4,911,355 | 3/1990 | Bannister | 229/916 X |
| 5,002,224 | 3/1991 | Muise . | |
| 5,429,296 | 7/1995 | Southwell et al. | 229/916 X |

FOREIGN PATENT DOCUMENTS

| | | | |
|---|---|---|---|
| 1289639 | 8/1962 | France . | |
| 1383824 | 4/1965 | France . | |
| 2329523 | 10/1975 | France . | |
| 2424192 | 4/1978 | France . | |
| 2457809 | 12/1980 | France | 229/916 |
| 331472 | 7/1936 | Italy | 220/676 |
| 556550 | 2/1957 | Italy . | |
| 368091 | 4/1963 | Switzerland . | |
| 965880 | 8/1964 | United Kingdom | 229/916 |

*Primary Examiner*—Allan N. Shoap
*Assistant Examiner*—Christopher J. McDonald
*Attorney, Agent, or Firm*—Watov & Kipnes, P.C.

[57] ABSTRACT

A container for storing and shipping produce made from a blank having top, bottom and side panels with apertures therein defining cut-out areas allowing the passage of vapor through the container, at least some of the apertures overlapping the top and side panels and/or the bottom and side panels, wherein the cut-outs area of the apertures in the top and bottom panels exceeds the cut-out area of the apertures in the side panels.

11 Claims, 3 Drawing Sheets

CONTAINER WITH APERTURES FOR VENTILATION

This application claims the benefit of U.S. Provisional Application No. 60/000,536, filed Oct. 2, 1995.

FIELD OF THE INVENTION

The present invention is directed to containers particularly adapted for storing and shipping produce and more particularly to a stackable container formed from corrugated paperboard or other stiff, resilient and bendable sheet materials, having apertures or slots for ventilation.

BACKGROUND OF THE INVENTION

Stackable containers are used to store and ship produce such as fruits, vegetables and the like. Traditionally, stackable containers were in the form of wooden boxes comprised of spaced-apart slats defining openings therebetween which could be readily packed with produce either in the field or at packing sheds. The packed containers could then be stacked, stored and shipped with the produce contained therein.

Since produce is extremely perishable, containers of produce have to be cooled quickly to just above freezing under high moisture conditions to prevent excessive respiration. The containers are typically stored at temperatures of from about 31° to 35° F. and a relative humidity of at least 90%. Cooling is generally carried out by re-circulating chilled humid air through the openings formed between the slats of the wooden boxes. Before cooling, the containers of produce must be fumigated to kill insects and the like.

Wooden boxes used to store produce are advantageous because the openings between the slats provide adequate ventilation. In addition, the boxes are sturdy and can therefore to be stacked one upon the other during storage. However, wooden boxes are disadvantageous because they are expensive to manufacture, employ non-recyclable materials and because their excessive weight adds to the cost of shipping and handling.

Paper materials, such as corrugated paperboard are lighter, recyclable and less expensive than wood. In recent years containers constructed from combinations of flat sheets of paperboard (e.g. linerboard/medium flute/linerboard) have been substituted for wooden boxes in some fruit and vegetable packing operations. Such paperboard containers are constructed from flat sheets of paperboard materials which are suitably cut and scored into a one-piece blank, and shipped to the user in a flattened condition. The blank can be folded to form a complete container in the field without the use of staples, adhesives, and the like.

There is still resistance to the use of containers constructed from paperboard materials because it has been difficult to provide both adequate ventilation and sturdiness. As with wooden boxes, paperboard containers must have sufficient ventilation and yet provide the sturdiness necessary to protect the contents during storing and shipping. It is customary to provide ventilation apertures or slots in the paperboard containers along each major surface or panel thereof as shown, for example, in J. M. Dunkin et al., U.S. Pat. No. 3,114,493; J. P. Hamilton, U.S. Pat. No. 3,157,346; R. W. Wiemann, U.S. Pat. No. 3,520,468; B. K. Baptist, U.S. Pat. No. 4,053,098; W. F. Cornell et al., U.S. Pat. No. 4,175,691; and H. D. Muise, U.S. Pat. No. 5,002,224, each incorporated herein by reference. The ventilation apertures typically have multiple axes of symmetry to facilitate the die cutting of the blanks.

It is generally preferred to provide ventilation apertures along the score lines defining adjacent panels of the blank.

When the blank is folded about the score line, a portion of the apertures will appear in each of the two adjacent panels. Such arrangements are disclosed in, for example, W. E. Owens, U.S. Pat. No. 3,973,723 and C. P. Welmer, U.S. Pat. No. 4,770,339, each incorporated herein by reference. As with the ventilation apertures mentioned above, the apertures in these patents have multiple axes of symmetry. Each aperture defines a cut-out area in which half of the cut-out area appears in each of the adjacent panels.

The number and size of the ventilation apertures are determined based on competing interests. On the one hand it is desirable to have a large cut-out area to ensure adequate ventilation for the circulation of the fumigants and cooling medium. On the other hand, the strength of the container decreases as the surface area of the apertures increases.

The prior arrangements of ventilation apertures described in the aforementioned patent citations are disadvantageous either because they do not enable rapid ventilation of the produce or because the containers are not rigid enough to provide adequate protection of the contents during storing and shipping.

It would therefore be a significant advance in the art of making containers for storing and shipping produce to provide the containers with an arrangement of ventilation apertures which enable the rapid and efficient infiltration and circulation of fumigants and cooling medium, such as cool air while minimizing the loss of stiffness of the container. As a result, the produce is protected when the containers are stacked one upon the other.

SUMMARY OF THE INVENTION

The present invention is directed to a stackable container, in which apertures or slots are provided in a unique arrangement to maximize circulation of fumigants and a cooling medium, such as cool air while retaining sufficient stiffness in the panels of the container to enable the containers to be stacked one upon the other without deforming.

More specifically, the present invention is directed to a container having top, bottom and side panels comprising apertures defining cut-out areas to allow the passage of vaporized materials (e.g. fumigants and cooling medium) therethrough, at least some of the apertures overlapping the top and side panels and/or at least some of the apertures overlapping the bottom and side panels, wherein the cut-out area of each of the overlapping apertures in the top and/or bottom panels exceeds the cut-out area of each of the overlapping apertures in the side panels.

In accordance with the present invention, the larger cut-out area in the top and/or bottom panels provides for enhanced ventilation of the contents of the container while minimizing the loss of stiffness so that the containers may be readily stacked and/or shipped.

BRIEF DESCRIPTION OF THE DRAWINGS

The following drawings in which like reference characters indicate like parts are illustrative of embodiments of the invention and are not intended to limit the invention as encompassed by the claims forming part of the application.

DETAILED DESCRIPTION OF THE INVENTION

Figure 1:
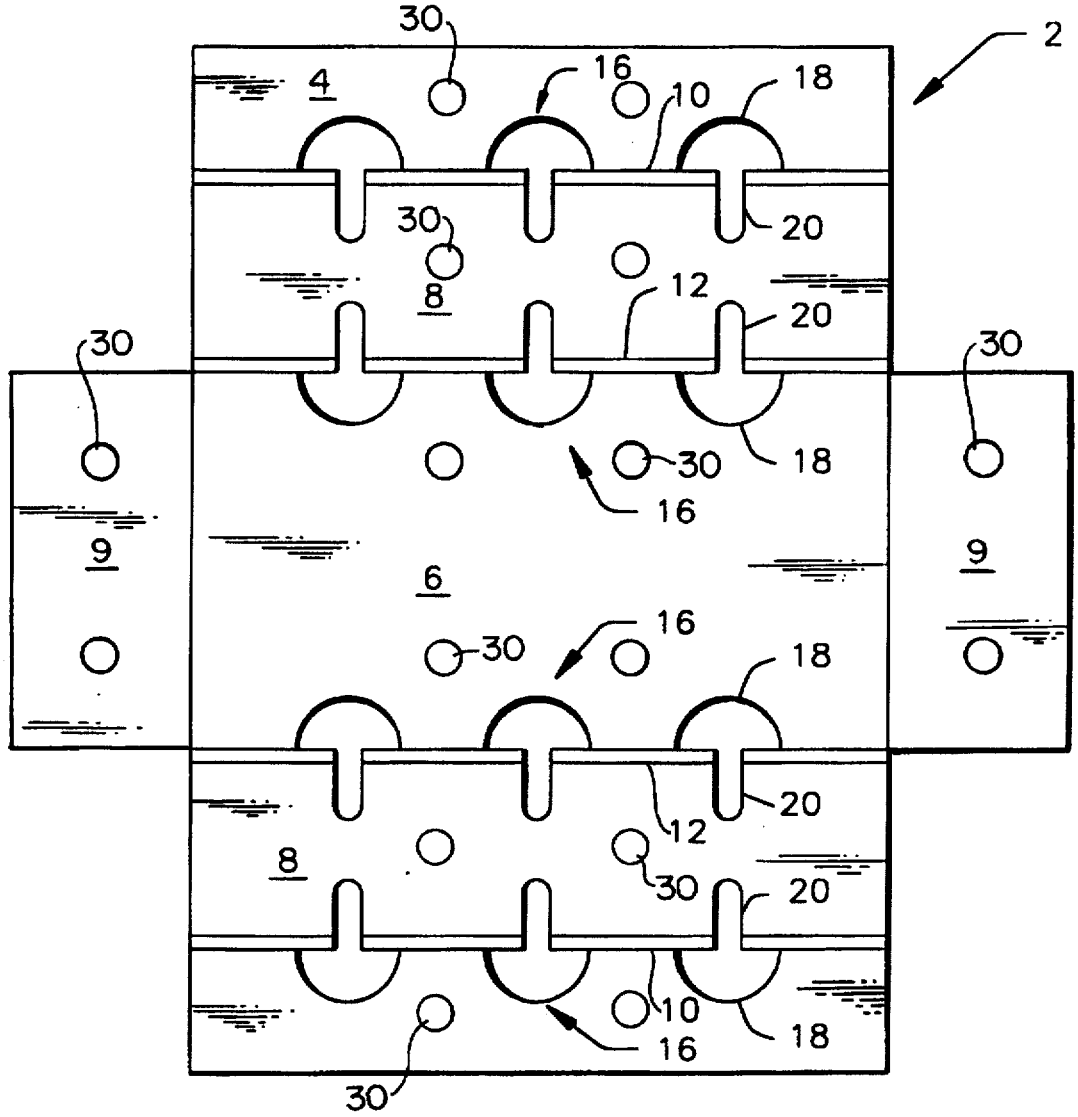
FIG. 1 is a partial schematic view of a blank for forming a container in accordance with the present invention.

The present invention is concerned with stackable containers, especially for storing and shipping produce such as fruits, vegetables and the like. In a preferred form of the invention, the container is particularly suited for storing and shipping grapes. Because the contents of the container are highly perishable, efforts must be made to maintain the produce at cool temperatures on the order of from about 31° to 35° F. In addition, the product must be fumigated typically with well-known vaporizable fumigants.

It is common for the produce to be picked in the field and immediately placed in the container. The containers are brought to a storage facility where they are stacked upon each other in columns. As is customary, the stacked containers are fumigated and then cooled with a cooling medium such as cool air to thereby rid the produce of insects and the like and to reduce the temperature of the produce and thereby the rate of respiration.

The containers must have apertures of sufficient area so that the fumigants and cool air can readily pass through and between each container and adequately pass among the produce contained therein. In addition, the container must possess sufficient structural strength so that the containers can be stacked one upon the other without deforming.

Applicants have discovered that apertures placed along the score lines of adjacent panels of the container (i.e. top and side panels as well as bottom and side panels) provide maximum ventilation while minimizing loss of structural integrity, when the cut-out area of the apertures in the top and/or bottom panels is greater than the cut-out area in the side panels.

When the containers of produce are stacked one upon the other the apertures in the top and bottom panels are substantially shielded from the atmosphere. Thus, it is difficult for fumigants and/or a cooling medium to pass through the stacked containers because the produce contained therein impedes the flow. The apertures in the side panels are not so restricted so that fumigants and the cooling medium can readily enter the containers. However, the flow is still impeded by the presence of the produce. Thus, the flow of fumigants and cooling medium between stacked containers is slowed making it difficult to employ paperboard type containers for the storage of produce.

Some improvement in the ventilation characteristics of paperboard containers is observed when the apertures appear along score lines so that portions of a single aperture appears in adjacent panels, as for example, in top and side panels. When the containers are stacked, fumigants and/or cooling medium can enter the portion of the aperture in the side panel and immediately rise to exit the container out of the top panel portion.

In accordance with the present invention, the portion of the aperture in the top panel or bottom panel is larger than the portion of the aperture in the side panels. When the containers are stacked one upon the other, the larger aperture portions of the top and bottom panels are aligned with each other. When fumigants and cooling medium enter the side panel portion of the apertures there is created a "chimney effect" in which the flow is rapidly drawn through the stacked containers. This is because the larger portion of the apertures in the top and bottom panels offer much less resistance to flow than in prior storage containers. As a result, there is more efficient use of both fumigants and cooling medium during the storage process.

Figure 2:
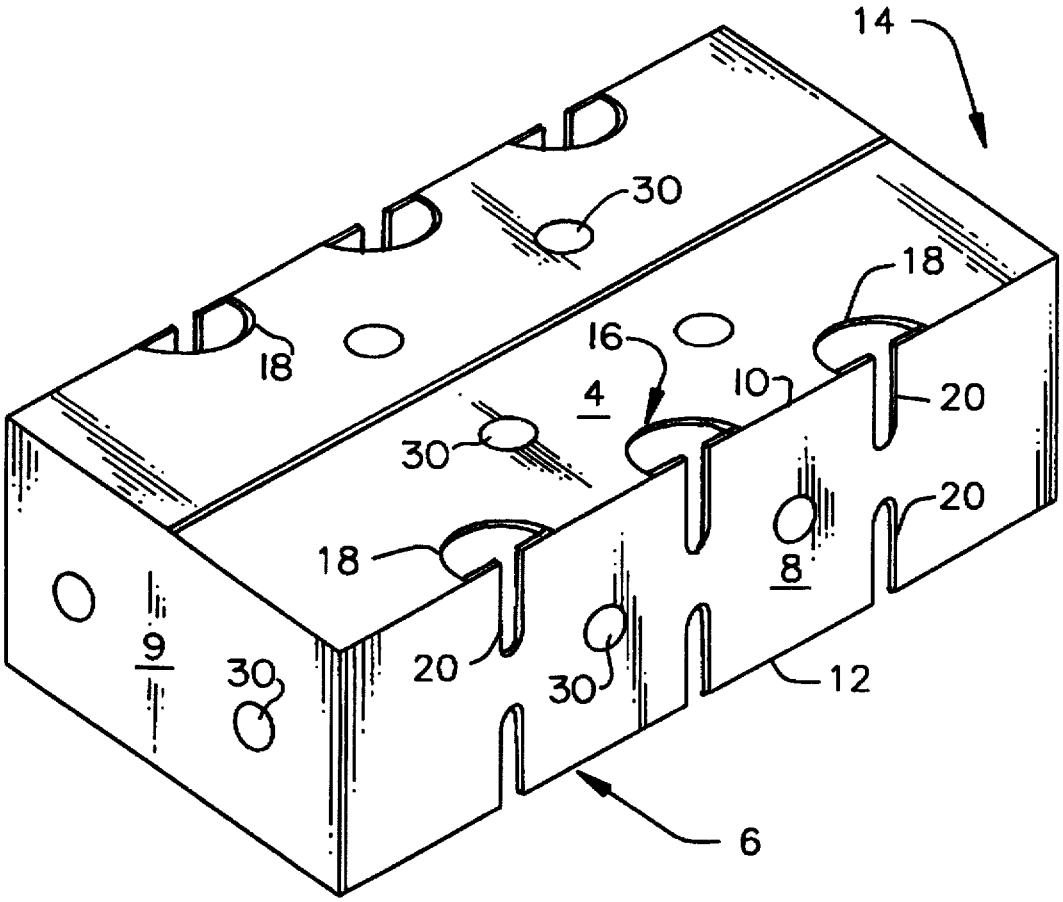
FIG. 2 is a perspective view of the blank of FIG. 1 folded in the form of a container.
Figure 3:
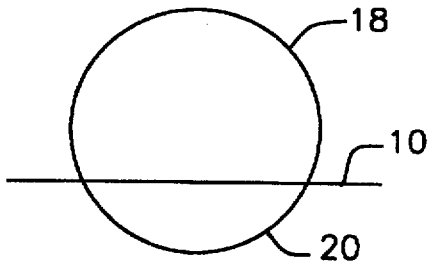
FIG. 3 is a side view of an embodiment of an aperture positioned on a score line for use in the present invention.

Referring to FIGS. 1 and 2, there is shown a one-piece blank 2 made of a stiff but foldable material such as corrugated paperboard or composite thereof (e.g. linerboard/medium flute/linerboard) and the like. The blank 2 is composed top panels 4, a bottom panel 6 and side panels 8 and 9. The top and side panels and the bottom and side panels are connected together through score lines 10 and 12, respectively. The folding of the panels about the respective score lines 10, 12 will form the blank 2 into the shape of a container 14 as shown best is FIG. 2.

In accordance with the present invention, a plurality of apertures 16 are provided in spaced-apart relationship along at least one of the score lines 10 or 12. Although the number of apertures along a single score line can vary, about 3 to 5 apertures are preferred. There is thus formed a cut-out area (i.e. surface area) having a first portion 18 in the top panel 4 or in the bottom panel 6 depending on whether the aperture 14 is positioned along the score line 10 connecting the top panel 4 and side panel 8 or along the score line 12 connecting the bottom panel 6 and side panel 8. A second portion 20 of the cut-out area is positioned in the side panel 8. In accordance with the present invention, the cut-out area of the first portion 18 of the aperture 16 is greater than the area of the second portion, preferably having a ratio of the respective surface areas 18, 20 of up to about 3:1.

The employment of apertures having a greater cut-out area in the top and bottom panels than the side panels enhances circulation of the fumigants and cooling medium by generating a chimney effect thereby making it easier for the flow to travel through and between containers. As a result, all containers of a stacked column are efficiently fumigated and cooled.

The side panels provide the structural strength needed to support the containers when they are stacked together. Anything which reduces the surface area or structural integrity of the side panels will adversely affect the strength of the container. Accordingly, the cut-out area of the aperture on the side panels is minimized in accordance with the present invention. Thus, the apertures 16 employed in the present invention have greater than 50% and preferably up to about 75% of the cut-out area on the side of the score lines 10 and 12 coincident with the top and bottom panels 4 and 6, respectively.

Figure 4:
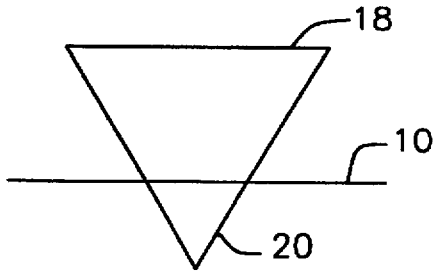
FIG. 4 is a side view of another embodiment of an aperture positioned on a score line for use in the present invention.
Figure 5:
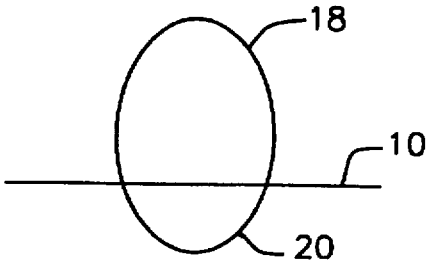
FIG. 5 is a side view of a still further embodiment of an aperture positioned on a score line for use in the present invention.
Figure 6:
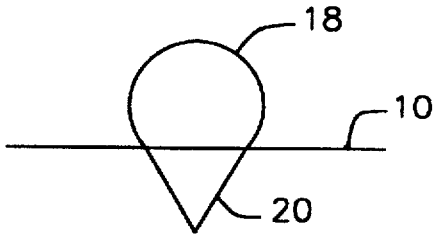
FIG. 6 is a side view of another embodiment of an aperture positioned on a score line for use in the present invention.
Figure 7:
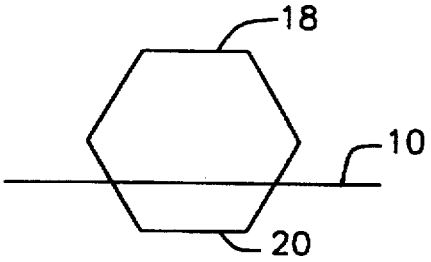
FIG. 7 is a side view of a further embodiment of an aperture positioned on a score line for use in the present invention.
Figure 8:
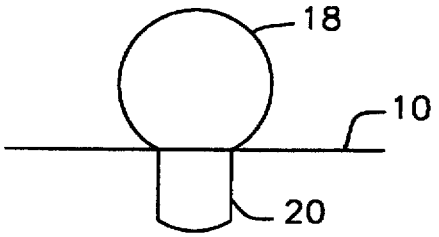
FIG. 8 is a side view of still another embodiment of an aperture positioned on a score line for use in the present invention.

As shown, for example, in FIGS. 3–7, the shape of the aperture may vary widely and includes circles, triangles, ellipses, polygons, irregular shapes such as shown specifically in FIGS. 6 and 8, combinations thereof and the like. The apertures therefore may have a single axis of symmetry or multiple axes of symmetry. What is critical to the present invention is that the cut-out area of the portion of the aperture in the top and/or bottom panels 4, 6 exceed the cut-out area of the portion of the aperture appearing in the side panels 8.

It will be appreciated that the container of the present invention may also include conventional apertures as shown in FIGS. 1 and 2 by numeral 30 which are not intersected by a score line. These apertures may appear in the side panels, top panels, bottom panels or combinations thereof and are typically of the type employed in the patent citations previously referred to. It is, however, preferred, that the total cut-out area of all apertures not exceed about 10% of the surface area of the container, most preferably in the range of from about 5 to 10%.

In a preferred form of the invention, the ratio of the cut-out area of the first portion 18 to the cut-out area of the second portion 20 is in the range of from above about 1:1 to up to about 3:1.

The container of the present invention can be manufactured by first forming a blank and then die-cutting the apertures therein with suitable dies.

COMPARATIVE EXAMPLE 1

Figure 9:
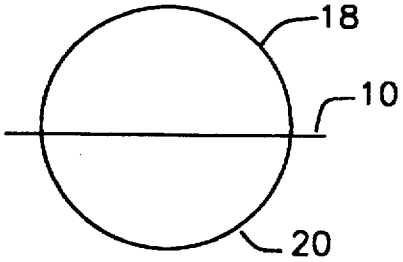
(PRIOR ART) FIG. 9
FIG. 9 is a side view of an aperture positioned on a score line in accordance with the prior art.

A paperboard blank having a total of 8 overlapping circular apertures (four on each side) along scores lines as shown in FIG. 9 was folded into a container. The circular apertures each had a radius of 18.25 mm and a cut-out area of about 1046 $mm^2$. The cut-out area of each aperture coincident with the top and bottom panels was therefore about 523 $mm^2$ and the cut-out area of each aperture coincident with the side panels was about 523 $mm^2$.

The container was tested for structural strength in a customary manner and found to withstand a pressure of 875 lb before deforming.

EXAMPLE 1

A container was formed in the same manner as Example 1 except that the blank contained a total of 8 vertically oriented elliptical apertures of the type shown in FIG. 5 having the dimensions of 44 mm×24 mm and a cut-out area for each aperture of about 1050 $mm^2$. The first portion of the cut-out area for each aperture coincident with the top and bottom panels was about 700 $mm^2$ and the cut-out area of the second portion of each aperture coincident with the side panels was about 350 $mm^2$.

The container was tested in the same manner as set forth in Example 1. The container was able to withstand a pressure of 940 lb before deforming.

EXAMPLE 2

A container was formed in the same manner as Example 1 except that the blank contained a total of eight triangular apertures of the type shown in FIG. 4, each having equal length sides measuring 49 mm. The cut-out area of each triangular aperture was about 1040 $mm^2$. The apex of the triangle appeared in the side panels such that the cut-out area of each aperture for the top and bottom panels was about 690 $mm^2$ and the cut-out area for each aperture for the side panels was about 350 $mm^2$.

The container was tested for structural strength as described in Example 1. The container was able to withstand a pressure of 920 lbs before deforming.

COMPARATIVE EXAMPLE 2

A container was formed of the same type described in Example 2 except that the triangular apertures were inverted so that the apex of the triangle appeared in the top and bottom panels. The cut-out area of each aperture for the top and bottom panels was therefore 350 $mm^2$ while the cut-out area for each portion of each aperture in the side panels was 690 $mm^2$.

The container was tested for structural strength in the same manner as Example 1. The container was able to withstand a pressure of 795 lb.

As shown by the Examples, the containers employing apertures in accordance with the present invention (i.e. wherein overlapping apertures have a greater cut-out area in the top and bottom panels than in the side panels) exhibited greater structural strength than containers where the side panels had the same or greater cut-out area than the top and bottom panels. In addition, the present containers provide for a more rapid and efficient flow of fumigants and cooling medium through containers stacked one upon the other.

What is claimed is:

1. A container having top, bottom and side panels comprising apertures defining cut-out areas allowing the passage of vaporized materials through the container, at least some of said apertures being overlapping apertures which overlap at least one pair of panels selected from the group consisting of the top and side panels and the bottom and side panels, wherein the cut-out area of each of said overlapping apertures comprises a first cut-out area in the side panel and a second cut-out area and wherein the area of the second cut-out area exceeds the area of the first cut-out area of each of said overlapping apertures.

2. The container of claim 1 comprising a first group of overlapping apertures overlapping the top and side panels and a second group of overlapping apertures overlapping the bottom and side panels.

3. The container of claim 1 further comprising non-overlapping apertures appearing entirely in at least one of the top, bottom or side panels.

4. The container of claim 1 wherein the total cut-out area of all of the apertures is up to about 10% of the total area of the container.

5. The container of claim 1 wherein the total cut-out area of all of the apertures is from about 5 to 10% of the total area of the container.

6. The container of claim 1 wherein the ratio of the area of the second cut-out area to the first cut-out area is in the range of from greater than about 1:1 to about 3:1.

7. The container of claim 1 wherein the overlapping apertures are in the shape of a polygon.

8. The container of claim 1 wherein the overlapping apertures are in the shape of a circle.

9. The container of claim 1 wherein the overlapping apertures are in the shape of a triangle.

10. The container of claim 1 wherein the overlapping apertures are in the shape of an ellipse.

11. The container of claim 1 wherein the overlapping apertures have an irregular shape, said first cut-out area having a first shape and said second cut-out area having a second shape, different than the first shape.

* * * * *